US008151866B2

(12) United States Patent
Ullwer et al.

(10) Patent No.: US 8,151,866 B2
(45) Date of Patent: Apr. 10, 2012

(54) METHOD AND APPARATUS FOR CASTING NF METAL BATHS, PARTICULARLY COPPER OR COPPER ALLOYS

(75) Inventors: Helmut Ullwer, Hettstedt (DE); Hendrik Busch, Wiederstedt (DE); Lothar Schillinger, Hettstedt (DE)

(73) Assignee: MKM Mansfelder Kupfer und Messing GmbH, Hettstedt (DE)

( * ) Notice: Subject to any disclaimer, the term of this patent is extended or adjusted under 35 U.S.C. 154(b) by 192 days.

(21) Appl. No.: 12/523,738

(22) PCT Filed: Jan. 15, 2008

(86) PCT No.: PCT/EP2008/000247

§ 371 (c)(1), (2), (4) Date: Aug. 26, 2009

(87) PCT Pub. No.: WO2008/087002

PCT Pub. Date: Jul. 24, 2008

(65) Prior Publication Data

US 2010/0044001 A1 Feb. 25, 2010

(30) Foreign Application Priority Data

Jan. 20, 2007 (EP) ..... 07001253

(51) Int. Cl.
*B22D 11/06* (2006.01)

(52) U.S. Cl. ..... 164/481; 164/432

(58) Field of Classification Search ..... 164/480–482, 164/428–434

See application file for complete search history.

(56) References Cited

U.S. PATENT DOCUMENTS

| | | | | |
|---|---|---|---|---|
| 4,593,742 | A * | 6/1986 | Hazelett et al. | 164/415 |
| 4,619,309 | A | 10/1986 | Huber | |
| 5,063,990 | A * | 11/1991 | Follstaedt et al. | 164/463 |
| 5,571,440 | A | 11/1996 | Eckert | |
| 5,804,136 | A | 9/1998 | Kagan | |
| 6,994,149 | B2 * | 2/2006 | Cloostermans | 164/437 |

FOREIGN PATENT DOCUMENTS

| | | | |
|---|---|---|---|
| DE | 2902426 | A1 | 8/1979 |
| EP | 0635323 | A1 | 1/1995 |
| EP | 0962271 | A1 | 12/1999 |

* cited by examiner

*Primary Examiner* — Kuang Lin

(74) *Attorney, Agent, or Firm* — Laurence A. Greenberg; Werner H. Stemer; Ralph E. Locher

(57) ABSTRACT

A method and apparatus for casting NF metal baths, particularly copper or copper alloys, to produce flat products at least 20 mm thick, ensure melt introduction into a pool while preventing gas pockets or impurities flushing into the melt of a casting mould. The melt continuously flows along a flow-off element from a tundish to a bath level of the mould, at a casting angle of up to 15° and a constant or decreasing rate, and is conducted below a pool surface of the mould without influencing flow rate. Vortexes generated by melt hitting the bath surface are prevented from extending within the mould by a cover surrounding a top surface of the flow-off element. Gaseous components produced when the melt flows, escape via a free space above the flow. Gravity determines a flow rate of the free melt flowing from tundish to molten bath of a revolving strip-casting mould.

23 Claims, 4 Drawing Sheets

METHOD AND APPARATUS FOR CASTING NF METAL BATHS, PARTICULARLY COPPER OR COPPER ALLOYS

BACKGROUND OF THE INVENTION

Field of the Invention

The invention relates to a method for casting NF metal baths, particularly copper or copper alloys, in order to produce flat products of at least 20 mm thickness, wherein a liquid metal bath from a distribution container (tundish) is introduced into the molten bath of a revolving strip-casting mould by means of a flow-off element at a defined casting angle running vertically downwards. In addition, the invention relates to a suitable apparatus for carrying out the method.

Different versions are already known of methods and apparatuses for feeding a metal melt from a distribution container or tundish into a mould. The melt in the tundish is introduced into the molten bath, the pool of the revolving strip-casting mould, by means of one or more pouring tubes. The pouring tube can be arranged vertically or at a defined angle inclined to the horizontal. The pouring tubes serve to ensure an even and low turbulence distribution of the melt in the strip-casting mould. Furthermore, the immersion of the pouring tubes into the pool and the discharge of the melt below the bath surface are intended to prevent the melt flow coming into contact with atmospheric oxygen. An adequate filling level in the tundish ensures that the pouring tube is completely filled with melt. The flow rate of the melt is affected by the metallostatic pressure of the melt in the tundish, dependent on the casting angle of the pouring tube.

With the increasing acceleration of the melt in the pouring tube, a negative pressure is produced, leading to turbulences and fluctuations in the bath level of the melt in the pool of the strip-casting mould.

A submerged tube for pouring metal melt is known from DE 101 13 026 A1. This has a turbulence chamber widening in a funnel-shaped manner for dissipating the kinetic energy of the melt at the outlet of the submerged tube. The killed melt gets to the pool through side outlets. The submerged tube is arranged vertically and has a flow disrupter at the transition from the tube section to the turbulence chamber A double belt continuous casting mould has been published in EP 0 194 327 A1 with a device for regulating the position of the meniscus. The tundish is connected to the pouring tube by a connecting tube bent at right angles. Said pouring tube consists of a section running horizontally and a section bent upwards which flows into the mould, with the outlet opening not immersed in the pool. The melt flow is repeatedly redirected up to its entry into the mould by the siphon-like arrangement of tundish, connecting tube and pouring tube.

A casting system is known from EP 1 506 827 A1 for a thin slab mould with a tundish and a submerged pouring tube in which the submerged tube tapering in the direction of the flow is arranged running obliquely downwards. The outlet opening of the submerged tube is located below the bath level of the mould. The outlet opening is covered by a lip and arranged in such a manner that the melt is redirected repeatedly and distributed transversally to the longitudinal axis of the mould.

With the known solutions with pouring tubes running in an inclined manner from the tundish into the lower lying mould, the pouring tube must be filled full of melt. Owing to the flow rate of the melt fed in below the bath surface, vortex formations occur in the pool even at a small inclination of the pouring tubes, causing gas pockets and oxidic and other impurities collecting on the surface to be flushed into the melt.

These cause entrapments in the flat products to be produced which have an adverse effect on quality. This problem is aggravated by the fact that dissolved gases are released from the melt during the cooling and solidification process which accumulate within the pouring tube directly at the adjoining wall. The gas pockets cause a cooling of the pouring tube section at these places. This causes the pouring tubes to bend upwards and their ends to protrude out of the pool, leading to further turbulence of the melt in the mould. Since pouring tubes arranged together bend to different extents, it is not possible to rectify this problem by lowering the tundish.

A radial flow distributor for the even, non-turbulent, and non dribbling pouring of melt into a continuous casting machine is known from EP 0 962 271 A1.

The distributor consists of a groove or channel with a base for forming a sump and a concave-shaped weir arranged downstream with a slotted opening or an overflow weir edge. A fan-shaped apron, whose top surface is at the same height as the overflow edge, is attached to the channel. The apron is arranged horizontally or at a slightly rising (2°) angle and has projecting side walls.

The outlet end of the apron is formed as a ramp inclined downwards at an angle of about 15°. Apron and ramp form an open pouring spout. The lower end of the ramp lies above the casting belt or the bath level of the mould or the casting device. In one embodiment variant the melt gets into the mould solely by gravity and with a melt with a free space above its surface. It is disadvantageous if the molten metal falls into the molten bath of the casting device over the entire width of the ramp. When the melt flows out, it contracts laterally, with vortexes being induced in the mould or casting device over a wide area. This can cause gas pockets or impurities to be flushed in and flow patterns to be formed in the strip which have an adverse effect on the quality of the finished product.

BRIEF SUMMARY OF THE INVENTION

The aim of the invention is to devise a method for casting NF metal baths, particularly copper or copper alloys, in order to produce flat products of at least 20 mm thickness, which guarantees an improved introduction of the melt into the pool and largely prevents gas pockets or impurities from being flushed into the melt of the mould. In addition, an apparatus suitable for carrying out the method is to be devised.

The technical aspects associated with the above aim have been solved in accordance with the invention by means of the features specified in the claims. Advantageous embodiments and modifications of the method are the subjects of dependent claims. Apparatuses suitable for carrying out the method are the subject of the independent claims. The dependent claims also relate to advantageous embodiments of the apparatuses.

In accordance with the proposed method the melt with a free space above its surface flows continuously from the tundish up to the bath level of the mould at a defined casting angle of up to 15° running vertically downwards along the flow-off element at a constant or decreasing rate, and is conducted below the surface of the pool of the mould without further influencing the flow rate. Vortexes generated when the melt hits the bath surface of the pool are prevented from extending two-dimensionally within the mould by means of a cover that surrounds the top surface of the flow-off element. Gaseous components produced during the melt flow are able to escape via the free space above the melt flow.

The melt flows out from the tundish in a channel to under the bath surface of the mould. By a channel is meant, on the one hand, a flow-off element in which the flow is surrounded only by a lower and lateral limitation (so-called open channel), and, on the other hand, a tube that is only partially filled. The melt flow within a channel therefore always flows with a "free surface" above the melt flow.

The amount flowing through the flow-off element is restricted solely at the inlet of the flow-off element by the preset filling height in the tundish.

The liquid molten metal in the distribution container is maintained at such a level that the flow-off element is only partially filled with melt, particularly where this is constructed as a tube. The melt flows freely over the edge of the tundish into the flow-off element. The filling level in the tundish is continuously monitored during this process.

The flow rate of the melt flowing from the tundish is determined essentially by gravity and is therefore low. If necessary, the flow rate of the melt along the flow-off element can be further reduced by a rough surface or by mechanical elements.

The flow-off element can also be designed in such a manner that the melt flow increases in width. The flow-off element is arranged at an angle of inclination to the horizontal of up to 15°. Since the flow-off element is only partially filled with melt, the melt flows at a comparatively low rate into the mould. The melt flowing in within this section reaches the stationary melt in this section because of the section of the flow-off element open at the end side immersed in the molten bath of the mould which is surrounded or enclosed by a sleeved-shape cover or boundary. Vortexes caused by the melt inflow are formed within the section surrounded by the sleeve-shaped cover. The melt gets below the surface of the pool of the mould as a calmed flow. There are therefore no formations of waves and vortexes on the pool surface outside the said section. Consequently, no impurities or gas pockets are flushed into the melt either. Because of the free space above the surface of the inflowing melt flow, gases released during the cooling of the melt can flow off or escape freely. When using known pouring tubes, there is a danger that such tubes can bend upwards during the feeding in of the melt. Since the flow-elements are only partially filled with melt in accordance with the invention, these can bend evenly only on the underside, if indeed they do bend at all. This can be corrected by lowering the tundish.

An apparatus suitable for carrying out the method can be fitted either with a tubular flow-off element or a flow-off element, a channel, open at the top. Pouring tube or channel are positioned at a defined casting angle extending obliquely downwards and are immersed in the molten bath of a revolving strip-casting mould.

A suitable pouring tube has at its immersing end a central outlet opening or an eccentric outlet opening pointing downwards. The cross-sectional area of the outlet opening is at least as big as the cross-sectional area of the pouring tube. The immersing section of the pouring tube has a cover limiting the outlet opening at least on its top surface.

A channel has a cover for forming a peripherally sealed section in the area of the inlet of the melt into the melt of the mould as a sleeve-shaped limitation of the central outlet opening.

The cover of the channel extends over a length of 40 to 250 mm, beginning at the outlet end of the channel. The covering section therefore projects above the bath level of the mould by approximately 20 to 100 mm. The sleeve-shaped cover can for example also be constructed as an attachable cover. The cross-sectional shape of the channel can be differently constructed, with the channel preferably having a semicircular, semi-oval or rectangular cross-sectional shape.

Where a tubular flow-off element is used, this is connected to the distribution container in such a manner that the metal or melt level in the distribution container is kept at a level at which the amount of melt that can flow off is such that that the pouring tube is partially filled, i.e. the melt flows through the pouring tube with a free space above its surface.

In its operating condition the pouring tube is partially filled with melt from the start of the inlet opening up to the bath level.

The immersing section of the pouring tube is constructed in such a manner that the outlet opening is limited peripherally by the wall of the pouring tube forming the cover.

This ensures that the free flowing melt hits the surface of the melt in the mould with a free space above it within the immersing section of the pouring tube.

When using a pouring tube it is advisable if this is enclosed up to its connection to the tundish in order to ensure a controlled atmosphere in the pouring tube. In certain applications the pouring tube can have a partly or completely open top surface above the immersing section, approximately 20 to 100 mm above the bath level, or can have one or more openings on the top surface through which vapours and gases forming within the immersing section can escape without difficulty.

The pouring tube or channel can be constructed in such a manner that their cross sections expand in width in the direction of flow, thus making possible a further reduction in the flow rate of the melt flow.

Dependent on the width of the strip to be cast and pouring output, several pouring tubes or channels can be arranged next to each other over the width of the strip to be cast. The surfaces of the pouring tube or channel coming into contact with the melt should preferably be roughened or fitted with mechanical elements, e.g. in the form of weirs arranged transversally to the direction of flow. The flow rate of the melt can be reduced still further by these measures.

In a further embodiment variant the pouring tube or channel is fitted with panel heating.

The flow-off element can also be constructed in its geometric shape as a pouring spout. However, the immersing section of a pouring spout must have a cover as is the case with a channel. The width of the immersing section of the pouring spout should preferably correspond roughly to the width of the strip.

A monitoring system can be fitted to maintain the required filling height in the distribution container.

The solution proposed is particularly suitable for the continuous production of copper strips with a width of 800 to 1500 mm and a thickness of 20 to 50 mm.

BRIEF DESCRIPTION OF THE SEVERAL VIEWS OF THE DRAWING

The invention is now to be explained by some examples. In the associated drawing.

DESCRIPTION OF THE INVENTION

Figure 1:
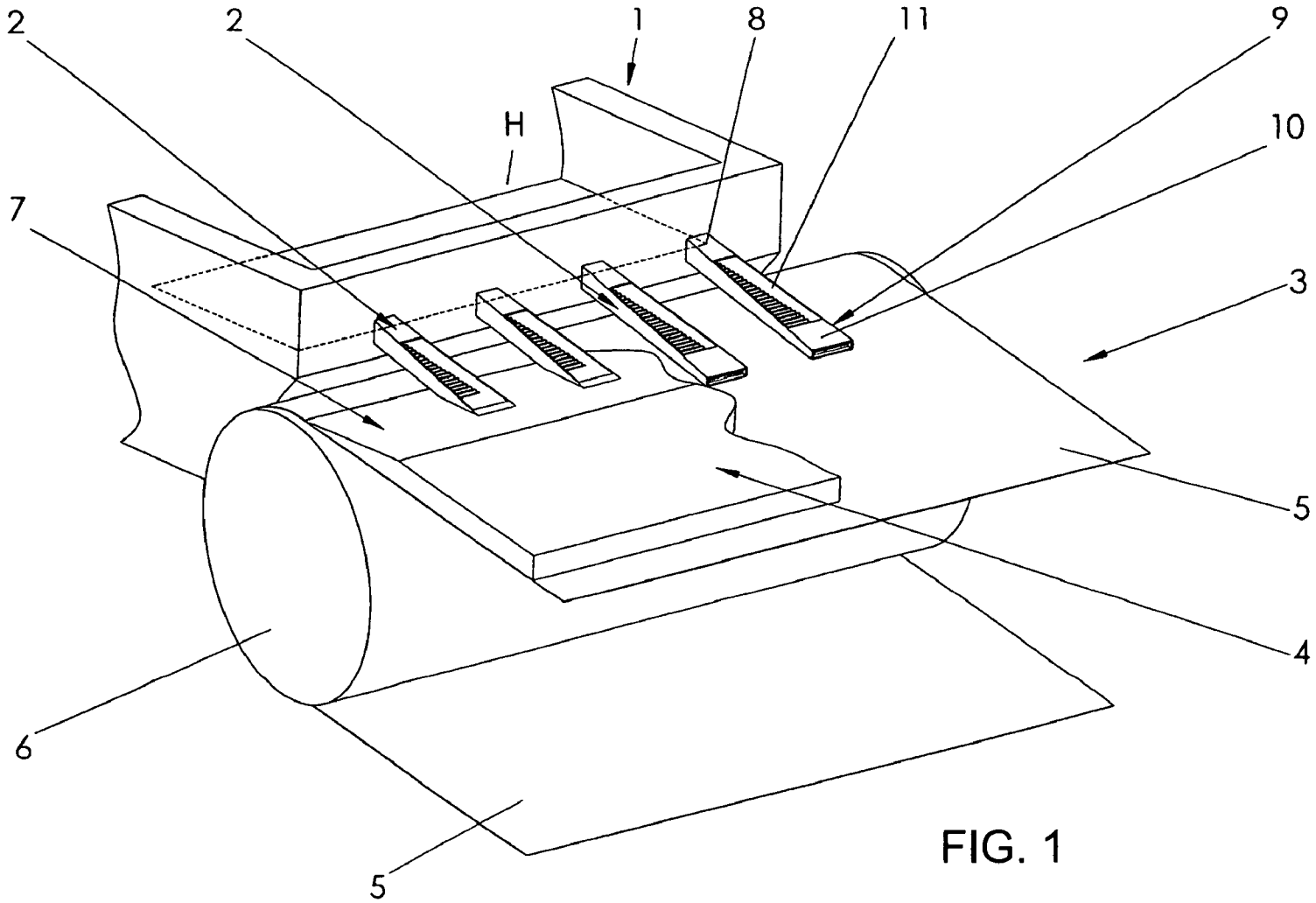
FIG. 1 shows an initial embodiment variant of the apparatus in accordance with the invention in simplified perspective representation.

FIG. 1 shows an apparatus for the continuous casting of strips using a revolving strip-casting mould. The apparatus consists of a tundish or distribution container 1 filled with liquid metal melt up to the filling level H. The filling level H is shown in FIG. 1 by a dotted line. Four channel-like flow-off elements 2, which are immersed in the molten bath (pool) 4 of the strip-casting mould 3, are connected at a defined angle of inclination of 9° for example in the front section of the tundish 1 pointing in the casting direction.

The strip-casting mould 3 consists of an upper and lower revolving casting strip 5 guided by deflection pulleys, of which, for reasons for clarity, only the lower casting strip 5 with the front deflection pulley 6 is represented in FIG. 1.

The liquid metal bath in the tundish or distribution container 1 is conducted by means of the flow-elements 2 between the casting strips 5 into the molten pool or pool 4 of the mould 3, and held between the cooled casting strips 5. During the further transport of the casting strips 5, which move at casting speed, the melt solidifies forming the desired flat product.

The casting strips 5 are tensioned during the casting process by means of the deflection pulleys.

The mould chamber is restricted on both its long sides by means of side walls which are not shown in greater detail, which determine the width of the strip to be cast. The mould 3 is arranged inclined at an angle of 9° to the horizontal for example. The melt located between the casting strips 5 is moved in the direction of discharge and solidified by cooling. The filling level or bath level in the mould 3 is denoted by the reference numeral 7. The discharge or strip speed of the casting strips 5 depends on the thickness of the strip to be cast.

In the example shown in FIG. 1 the melt is fed in from the distribution container 1 into the mould 3 via four identically constructed channel-like flow-off elements 2. These have a closed upper section 8 where they are fixed in the distribution container 1. The individual channels 2 have a rectangular cross section and expand in width in the direction of flow. The lower section 9 of the channel 2 immersing in the melt of the mould 4 is fitted with a sleeve-shaped cover 10. The cover 10 projects over the bath level 7 by approximately 20 to 100 mm. The channel 2 is open on its top surface (free space 11) between the lower section 9 and the upper section 8. The cover 10 can already be a component of the channel or attached and fixed after manufacture of the channel. The cross-sectional shape of the channel can vary, with the rectangular shape having proved to be advantageous.

Figure 2:
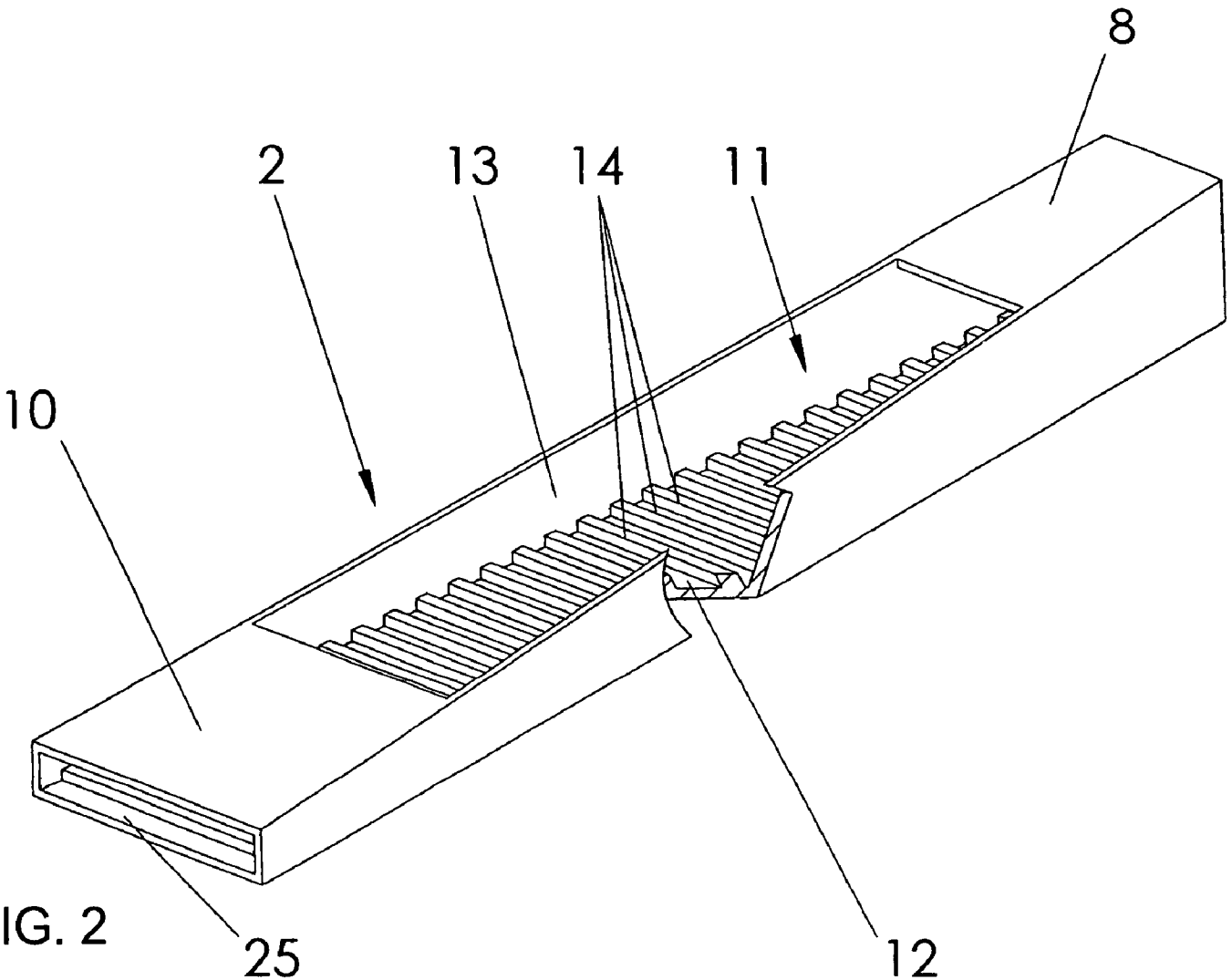
FIG. 2 shows a cross sectional view of a channel shown in FIG. 1 in enlarged representation.

FIG. 2 shows a channel 2 as an individual component. The channel 2 has a base 12 and two narrow side walls 13 as well as an outlet opening 25. Its inner sides are roughened to reduce the flow rate of the melt flow. In addition, mechanical elements are arranged in the form of weirs 14 extending transversally to further reduce the flow rate.

Figure 3:
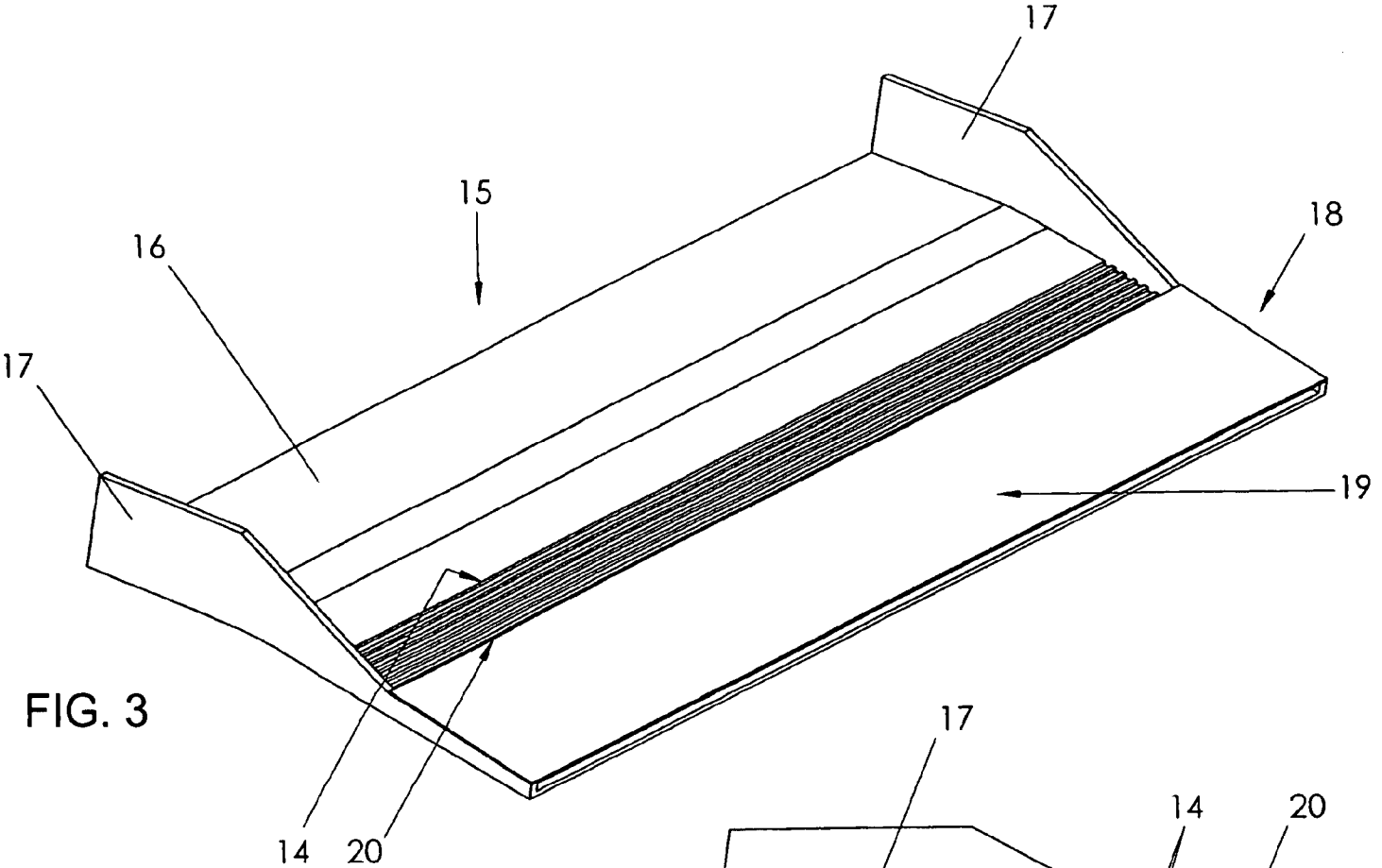
FIG. 3 shows a channel constructed as a pouring spout.
Figure 4:
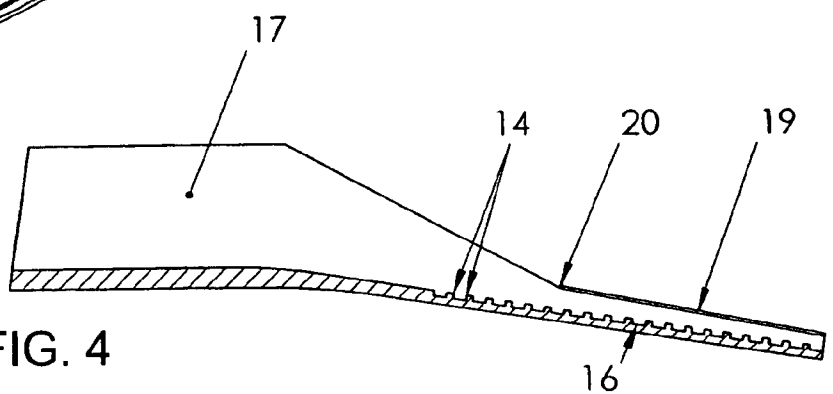
FIG. 4 shows a side view of the pouring spout shown in FIG. 3

FIGS. 3 and 4 show a channel constructed as a pouring spout 15 whose width corresponds to the width of the strip to be cast. The pouring spout is inserted in an opening provided on the front section of the tundish and arranged at an angle inclined to the horizontal in a similar manner to the channels previously described. The pouring spout 15 has a base 16 and two side walls 17.

The front section 18 immersed in the pool of the mould is fitted with a cover 19 immersed in the pool of the mould. The pouring spout is arranged in such a manner that the upper edge 20 of the cover projects over the bath level of the mould by 20 to 100 mm. The length of the cover 19 corresponds to about ⅓ of the length of the pouring spout. In the front section of the pouring spout weirs 14 are arranged transversally on the base 16, as can be seen in FIG. 4 particularly.

Figure 5:
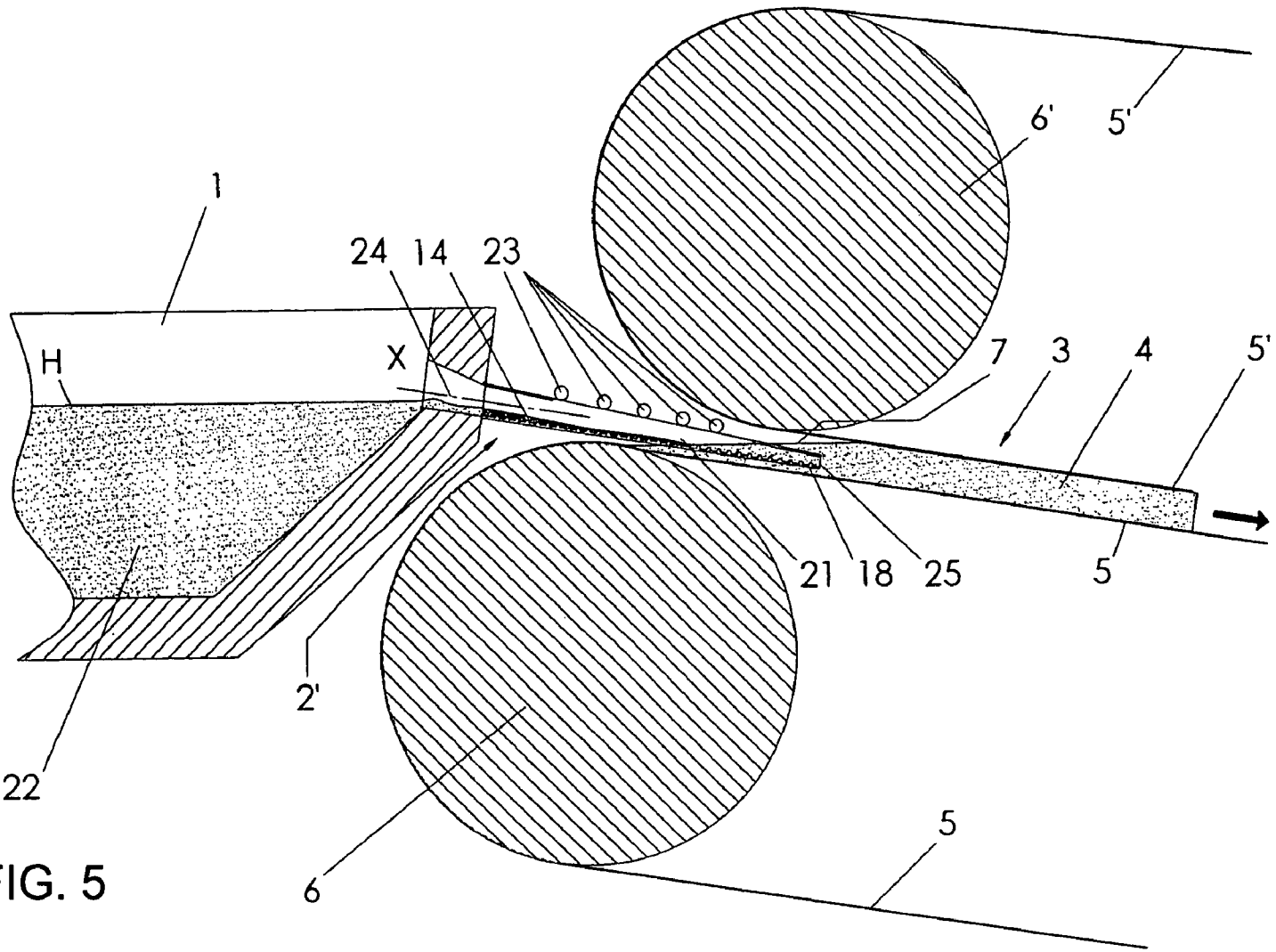
FIG. 5 shows a side view of a second embodiment variant of the apparatus in accordance with the invention in simplified perspective representation.

A second embodiment variant is shown in FIG. 5 in which the flow-off element is constructed as a pouring tube 2'. The pouring tube 2' is connected to the tundish 1 at the same angle of inclination as the channel 2. The mould 3 is constructed in a similar manner, as shown in FIG. 1. The upper casting strip 5' and the associated front deflection pulley 6' can also be seen in FIG. 5. The pouring tube 2' has an outlet opening 25 at the end of the section 18 that is immersed in the pool 4. In the lower section 18 the melt is at the same height as the bath level 7. It is essential that the pouring tube 2' is only partially filled in the operating condition. There is a free space 21 extending up to the tundish 1 above the melt stream flowing off in the pouring tube 2'.

The inlet opening 24 of the pouring tube 2' is connected to the distribution container at the connection point in such a manner that the filling height H in the distribution container 1 lies at a level between the central axis X and above the lower edge of the inlet opening 24 of the pouring tube 2'. The filling height H in the tundish 1 is constantly kept at such a level that the melt flows off almost pressureless, and a free space 21 is retained in the pouring tube 2' along the melt flow path up to the top surface. On the top surface of the pouring tube 2' there are several vents through which gases formed during the feeding in of the melt can escape. This prevents gaseous components from being flushed into the melt of the mould. The inflowing melt 22 reaches the melt of the mould as a flat and calmed flow with a relatively low flow rate. The flow rate is determined essentially by the viscosity of the melt and the inclination of the pouring tube 2' or the channel 2 and the roughness of the inner wall. The flow rate can be further reduced by additional installed components such as transversally arranged weirs 14. Vortexes on the bath surface generated during the flowing in of the melt can spread only within the peripherally enclosed section 18 of the pouring tube 2' and cannot spread two-dimensionally over the entire still molten bath level. Similarly, this also applies when a channel is used since the immersing section 9 of the channel 2 is surrounded by a cover 10, 19. The pouring tube 2' shown in FIG. 5 also expands widthways in the direction of flow. In addition, the pouring tube 2' is fitted with panel heating 23 in the lower section. The filling level in the tundish 1 is monitored, with the same amounts of melt being continuously fed in as flow off via the flow-off elements 2, 2' into the mould.

The invention claimed is:

1. A method for casting NF metal baths to produce flat products with a thickness of at least 20 mm, the method comprising the following steps:

providing a tundish or distribution container;

providing a revolving strip-casting mould having an entry leading to a molten bath;

providing at least one flow-off element connected to the tundish or distribution container for introducing a metal melt into the molten bath at the entry of the mould, the at least one flow-off element being a channel defined by a base and two sidewalls, the channel being disposed at a defined casting angle running obliquely downwards and having a central outlet opening immersed in the molten bath of the mould, the channel having a cover disposed in vicinity of the entry of the melt into the mould forming a peripherally enclosed section as a sleeve-shaped limitation of the central outlet opening, the cover extending between the two sidewalls, the channel having a partially or completely open upper surface upstream of the cover;

continuously feeding a liquid metal melt from the tundish into the molten bath of the mould substantially by gravity with the at least one flow-off element while defining a free space above a top surface of the at least one flow-off element;

conducting a flow of the melt from the tundish continuously to a bath level of the mould at a defined casting angle of up to 15° running obliquely downwards along the at least one flow-off element at a constant or decreasing speed;

conducting the melt below a pool of the mould without further influence on a flow rate;

the cover preventing vortexes generated when the melt hits a bath surface from extending two-dimensionally within the mould; and allowing gaseous components produced during the melt flow to escape at the free space above the melt flow.

2. The method according to claim 1, which further comprises maintaining the liquid metal melt in the tundish at a level causing the at least one flow-off element to be only partially filled with melt.

3. The method according to claim 1, which further comprises reducing a flow rate of the melt along the at least one flow-off element with a rough surface and/or mechanical elements.

4. The method according to claim 1, which further comprises expanding the melt flow in width along the at least one flow-off element.

5. An apparatus for casting NF metal baths to produce flat products with a thickness of at least 20 mm, the apparatus comprising:

a tundish or distribution container;

a revolving strip-casting mould for a molten bath;

at least one flow-off element connected to said tundish or distribution container for introducing a metal melt into the molten bath of said mould, said at least one flow-off element being a pouring tube disposed at a defined casting angle running obliquely downwards and immersed in the molten bath of said mould;

said pouring tube having a cross sectional area increasing in a direction of flow from said tundish to said revolving strip-casting mould and an immersing section with an upper surface and an immersing end;

said immersing end having a central outlet opening or an eccentric outlet opening pointing downwards, and said outlet opening having a cross sectional area at least as large as said cross sectional area of said pouring tube; and a cover disposed on said upper surface of said immersing section and delimiting said outlet opening, said pouring tube having a partially or completely open upper surface upstream of said cover.

6. An apparatus for casting NF metal baths to produce flat products with a thickness of at least 20 mm, the apparatus comprising:

a tundish or distribution container;

a revolving strip-casting mould having an entry leading to a molten bath; and at least one flow-off element connected to said tundish or distribution container for introducing a metal melt into the molten bath at said entry of said mould;

said at least one flow-off element being a channel defined by a base and two sidewalls, said channel being disposed at a defined casting angle running obliquely downwards and having a central outlet opening immersed in the molten bath of said mould;

said channel having a cover disposed in vicinity of said entry of the melt into said mould forming a peripherally enclosed section as a sleeve-shaped limitation of said central outlet opening, said cover extending between said two sidewalls, and said channel having partially or completely open upper surface upstream of said cover.

7. The apparatus according to claim 6, wherein said channel has an outlet end, and said cover of said channel extends over a length of 40 to 250 mm, beginning at said outlet end of said channel.

8. The apparatus according to claim 6, wherein said cover of said channel is an attachable component.

9. The apparatus according to claim 6, wherein said channel has a cross-sectional shape selected from the group consisting of semicircular, semi-oval and rectangular.

10. The apparatus according to claim 5, wherein said upper surface of said pouring tube has one or more openings.

11. The apparatus according to claim 5, wherein said pouring tube has a cross section extending width-wise in a direction of flow.

12. The apparatus according to claim 6, wherein said channel has a cross section which expands width-wise in the direction of flow.

13. The apparatus according to claim 5, wherein said pouring tube is one of several pouring tubes distributed over a width of a strip to be cast.

14. The apparatus according to claim 6, wherein said channel is one of several channels distributed over a width of a strip to be cast.

15. The apparatus according to claim 5, wherein said pouring tube has roughened surfaces coming into contact with the melt.

16. The apparatus according to claim 6, wherein said channel has roughened surfaces coming into contact with the melt.

17. The apparatus according to claim 5, wherein said pouring tube has mechanical elements to reduce a flow rate of the melt.

18. The apparatus according to claim 6, wherein said channel has mechanical elements to reduce a flow rate of the melt.

19. The apparatus according to claim 17, wherein said mechanical elements are weirs disposed transversely to a direction of flow.

20. The apparatus according to claim 18, wherein said mechanical elements are weirs disposed transversely to a direction of flow.

21. The apparatus according to claim 5, wherein said pouring tube has panel heating.

22. The apparatus according to claim 6, wherein said channel has panel heating.

23. The apparatus according to claim 6, wherein said channel is a pouring spout.

* * * * *